US010083778B2

(12) United States Patent
Persberg et al.

(10) Patent No.: US 10,083,778 B2
(45) Date of Patent: Sep. 25, 2018

(54) DYNAMIC SUBMARINE POWER CABLE

(71) Applicant: NKT HV Cables GmbH, Baden (CH)

(72) Inventors: Andreas Persberg, Karlskrona (SE); Andreas Tyrberg, Lyckeby (SE)

(73) Assignee: NKT HV Cables GmbH, Baden (CH)

( * ) Notice: Subject to any disclaimer, the term of this patent is extended or adjusted under 35 U.S.C. 154(b) by 0 days.

(21) Appl. No.: 15/562,623

(22) PCT Filed: Apr. 10, 2015

(86) PCT No.: PCT/EP2015/057795
§ 371 (c)(1),
(2) Date: Sep. 28, 2017

(87) PCT Pub. No.: WO2016/162076
PCT Pub. Date: Oct. 13, 2016

(65) Prior Publication Data
US 2018/0114613 A1 Apr. 26, 2018

(51) Int. Cl.
*H01B 7/18* (2006.01)
*H01B 7/02* (2006.01)
*H01B 7/14* (2006.01)

(52) U.S. Cl.
CPC ..... *H01B 7/1805* (2013.01); *H01B 7/0225* (2013.01); *H01B 7/14* (2013.01)

(58) Field of Classification Search
CPC ..... H01B 7/18; H01B 9/025
USPC ..... 174/102 R, 106 R, 113 R
See application file for complete search history.

(56) References Cited

U.S. PATENT DOCUMENTS 1,880,060 A * 9/1932 Wanamaker ..... H01B 7/045 174/107
2,604,509 A * 7/1952 Blanchard ..... H01B 7/046 138/130
3,177,901 A * 4/1965 Pierce ..... F16C 1/26 138/130

(Continued)

FOREIGN PATENT DOCUMENTS

EP 1998340 A1 12/2008

OTHER PUBLICATIONS

PCT International Search Report & Written Opinion Application No. PCT/EP2015/057795 Completed date: Nov. 20, 2015; dated Nov. 27, 2015 10 Pages.

*Primary Examiner* — Chau N Nguyen
(74) *Attorney, Agent, or Firm* — Whitmyer IP Group LLC

(57) ABSTRACT

A dynamic submarine power cable including a first conductor, a first insulation system layer, a first sheath, and a first screen layer arranged between the first insulation system layer and the first sheath. The first screen layer includes a plurality of first screen wires each having a first diameter and a plurality of first polymer wires each having a second diameter which is larger than the first diameter. The first screen wires and the first polymer wires are arranged in a helical manner around the first insulation system layer. The first screen wires and the first polymer wires are arranged alternatingly along the periphery of the first insulation system layer in any cross section. A radial distance between the central axis of any of the first screen wires and the central axis of the first conductor is less than a radial distance between the central axis of any of the first polymer wires and the central axis of the first conductor.

19 Claims, 1 Drawing Sheet

(56) References Cited

U.S. PATENT DOCUMENTS

| | | | | | |
|---|---|---|---|---|---|
| 3,261,907 | A | * | 7/1966 | Morrison | H01B 7/30<br>174/114 R |
| 4,197,423 | A | * | 4/1980 | Fusen | H01B 7/14<br>174/107 |
| 4,317,000 | A | * | 2/1982 | Ferer | H01B 7/182<br>138/130 |

* cited by examiner

DYNAMIC SUBMARINE POWER CABLE

TECHNICAL FIELD

The present disclosure generally relates to power cables. In particular it relates to dynamic submarine power cables.

BACKGROUND

Submarine power cables typically comprise a conductor and an electrical insulation system. Power cables of this type may further comprise a screen arranged around the electrical insulation system for carrying earth fault, and capacitive current and leakage currents. For medium voltage cables, without a metallic sheath, helically laid copper wires or overlapping copper tape is normally used as screen.

Submarine power cables may be designed to be utilised in dynamic applications, where the cable undergoes repeated bending during its service life. Dynamic submarine power cable may for example be hanging into the sea from an offshore structure. The submarine power cable will thus be exposed to wave-induced bending forces as well as to varying degrees of tension. The screen will therefore be exposed to fatigue stresses. The magnitude of the fatigue stresses depends on the design of the screen, contact forces and friction coefficient between the screen and surrounding layers. The contact force onto each core depends on the tensile force in the cable, radial pressure from sheaths and contact with surrounding structures such as a bend stiffener or bell mouth.

If the fatigue stresses are too large it will result in fatigue failure of the screen. This may in turn lead to corona discharges in the unscreened, unearthed area and eventually to the destruction of the electrical insulation system.

SUMMARY

The helix geometry of the screen wires allows the screen wires to slip in order to release axial stresses built up when the submarine power cable is bent. The main stresses in the screen wires resulting from bending are 1.) local bending stress due to bending of the screen wire, and 2.) friction stresses resulting from the stick-slip behaviour of the helical screen wire when the power cable is bent. The diameter of the screen wires is comparatively small and the bending stresses of the wire will therefore not contribute significantly to the fatigue stresses in the wire. The friction stresses, which are related to the contact forces onto the wire and the friction coefficient, are significantly larger compared to the bending stresses since they are related to the radial distance from the centre of the core to the screen wire. The friction stresses are thus more important for the fatigue life of the screen wires than the local bending stress. The friction stresses increase with increasing contact forces onto the screen wire. The contact forces onto the screen wires increase with increasing forces onto the cores for instance due to larger tensile force in the cable.

In view of the above, an object of the present disclosure is to solve, or at least mitigate, the problems of the prior art.

Hence, according to a first aspect of the present disclosure there is provided a dynamic submarine power cable comprising: a first conductor, a first insulation system layer arranged around the first conductor, a first sheath arranged around the first insulation system layer, and a first screen layer arranged between the first insulation system layer and the first sheath, wherein the first screen layer comprises a plurality of first screen wires each having a first diameter and a plurality of first polymer wires each having a second diameter which is larger than the first diameter, wherein the first screen wires and the first polymer wires are arranged in a helical manner around the first insulation system layer, along the axial direction of the first conductor, and wherein in any cross-section of the dynamic submarine power cable the first screen wires and the first polymer wires are arranged alternatingly along the periphery of the first insulation system layer, wherein a radial distance between the central axis of any of the first screen wires and the central axis of the first conductor is less than a radial distance between the central axis of any of the first polymer wires and the central axis of the first conductor.

An effect which may be obtainable by means of the smaller diameter first screen wires relative to the diameter of the first polymer wires is that the first screen wires will be subjected to less radial contact forces and hence reduced friction stress, in particular because they do not contact the first sheath as a result of the position of the larger diameter first polymer wires. The first polymer wires will hence transmit the majority of any radial forces onto the cores. Polymers have a higher mechanical strength in terms of being able to withstand large strains compared to metallic screen wires acting as means for shielding. To this end, the risk of fatigue failure of the first screen wires is greatly reduced.

With a dynamic submarine power cable is meant a power cable that is designed to handle dynamic loads constantly during its entire service life. In contrast, static power cables are designed to handle dynamic loads during the cable laying process, but not during their service life.

According to one embodiment each first polymer wire simultaneously abuts both the first insulation system layer and the first sheath.

According to one embodiment the number of first screen wires is equal to the number of first polymer wires.

According to one embodiment the second diameter is at least 1.2 times greater than the first diameter.

According to one embodiment each first screen wire is made of metal.

According to one embodiment each first polymer wire consists of a polymer material.

One embodiment comprises a second conductor, a second insulation system layer arranged around the second conductor, a second sheath arranged around the second insulation system layer, and a second screen layer arranged between the second insulation system layer and the second sheath, wherein the second screen layer comprises a plurality of second screen wires each having said first diameter and a plurality of second polymer wires each having said second diameter, wherein the second screen wires and the second polymer wires are arranged in a helical manner around the second insulation system layer, along the axial direction of the second conductor, and wherein in any cross-section of the dynamic submarine power cable the second screen wires and the second polymer wires are arranged alternatingly along the periphery of the second insulation system layer, wherein a radial distance between the central axis of any of the second screen wires and the central axis of the second conductor is less than a radial distance between the central axis of any of the second polymer wires and the central axis of the second conductor.

According to one embodiment each second polymer wire simultaneously abuts both the second insulation system layer and the second sheath.

According to one embodiment the number of second screen wires is equal to the number of second polymer wires.

According to one embodiment each second screen wire is made of metal.

According to one embodiment each second polymer wire consists of a polymer material.

One embodiment comprises a third conductor, a third insulation system layer arranged around the third conductor, a third sheath arranged around the third insulation system layer, a third screen layer arranged between the third insulation system layer and the third sheath, wherein the third screen layer comprises a plurality of third screen wires each having said first diameter and a plurality of third polymer wires each having said second diameter, wherein the third screen wires and the third polymer wires are arranged in a helical manner around the third insulation system layer, along the axial direction of the third conductor, and wherein in any cross-section of the dynamic submarine power cable the third screen wires and the third polymer wires are arranged alternatingly along the periphery of the third insulation system layer, wherein a radial distance between the central axis of any of the third screen wires and the central axis of the third conductor is less than a radial distance between the central axis of any of the third polymer wires and the central axis of the third conductor.

According to one embodiment each third polymer wire simultaneously abuts both the third insulation system layer and the third sheath.

According to one embodiment the number of third screen wires is equal to the number of third polymer wires.

According to one embodiment each third screen wire is made of metal.

According to one embodiment each third polymer wire consists of a polymer material.

According to one embodiment the first sheath forms part of a first core, the second sheath forms part of a second core and the third sheath forms part of a third core, wherein the dynamic submarine power cable comprises an armouring layer comprising a plurality of armouring wires, three filler devices, each filler device being arranged between a respective pair of adjacent cores of the first core, the second core and the third core, wherein the armouring layer is arranged around the first core, the second core, the third core and the three filler devices, and an outer sheath arranged around the armouring layer.

According to one embodiment the dynamic submarine power cable is a medium voltage power cable or a high voltage power cable.

Generally, all terms used in the claims are to be interpreted according to their ordinary meaning in the technical field, unless explicitly defined otherwise herein. All references to "a/an/the element, apparatus, component, means, etc. are to be interpreted openly as referring to at least one instance of the element, apparatus, component, means, etc., unless explicitly stated otherwise.

BRIEF DESCRIPTION OF THE DRAWINGS

The specific embodiments of the inventive concept will now be described, by way of example, with reference to the accompanying drawings, in which.

DETAILED DESCRIPTION

Figure 1:
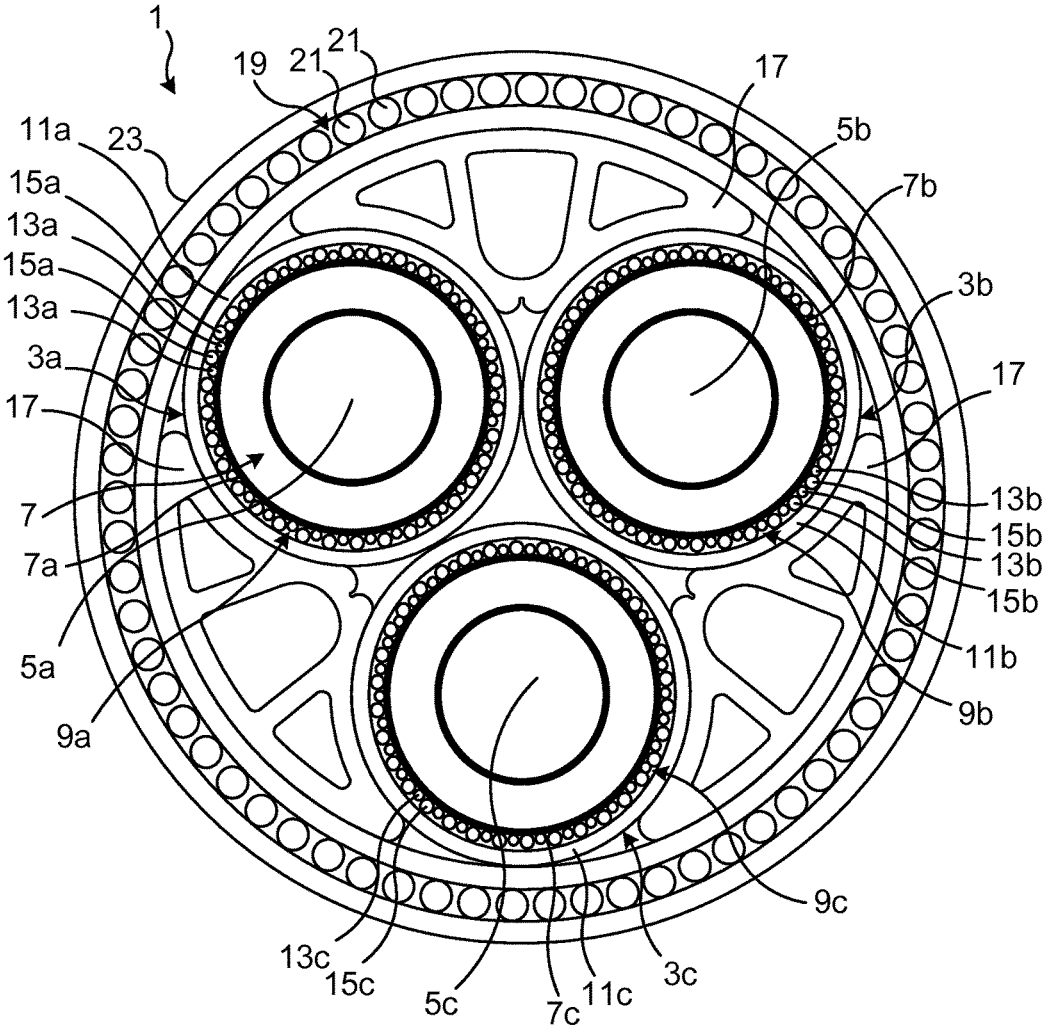
FIG. 1 shows a portion, about 120 degrees, of a cross-section of a dynamic submarine power cable having three cores.

The inventive concept will now be described more fully hereinafter with reference to the accompanying drawings, in which exemplifying embodiments are shown. The inventive concept may, however, be embodied in many different forms and should not be construed as limited to the embodiments set forth herein; rather, these embodiments are provided by way of example so that this disclosure will be thorough and complete, and will fully convey the scope of the inventive concept to those skilled in the art. Like numbers refer to like elements throughout the description.

The present disclosure relates to a dynamic submarine power cable designed to handle dynamic loads during its entire service life. The dynamic submarine power cable may be a regular dynamic submarine power cable or it may be an umbilical, i.e. a cable which in addition to being able to transmit electric power also may be able to provide e.g. hydraulic power to machines located on the seabed. The dynamic submarine power cable may be a medium voltage power cable or a high voltage power cable. The dynamic submarine power cable may be an alternating current (AC) dynamic submarine power cable or a direct current (DC) dynamic submarine power cable.

In general, the dynamic submarine power cable comprises a conductor, an insulation system, comprising an insulation system layer, arranged around the conductor, a sheath arranged around the insulation system layer, and a screen layer arranged between the insulation system layer and the sheath. The conductor, the insulation system layer, the screen layer and the sheath are hence concentrically or essentially concentrically arranged. The screen layer is arranged to provide electrical shielding of the conductor. The insulation system layer may for example be a semiconducting layer, for example a cross-linked polyethylene (XLPE) layer comprising carbon black. The insulation system layer may define or form part of an electrical insulation system. The electrical insulation system may thus comprise one or more insulation system layers. In variations having several insulation system layers, the insulation system layers may be different; one layer may for example be an electrically insulating layer and one or more layers may for example be semiconducting layer(s). As an example an electrical insulation system may comprise three concentrically arranged insulation system layers, an inner semiconducting layer, an outer semiconducting layer, and an electrically insulating layer arranged between the inner semiconducting layer and the outer semiconducting layer.

The conductor, the insulation system layer, the screen layer and the sheath forms or forms part of a core of the dynamic submarine power cable. The dynamic submarine power cable furthermore comprises one or more armouring layer(s) arranged around the screen layer, and an outer sheath.

The screen layer comprises a plurality of screen wires each having a first diameter and a plurality of polymer wires each having a second diameter that is larger than the first diameter. Each screen wire is normally circular or essentially circular in cross section, and typically consists of a single wire or a plurality of thinner parallel wires which together form a screen wire with a circular or essentially circular cross section. Each polymer wire is typically circular or essentially circular in cross-section. Other cross-sectional shapes of the polymer wires are also contemplated; the polymer wires may for example have a square-shaped cross-section, or other polygonal cross-sectional shape such as hexagonal or octagonal cross-sectional shape. The second diameter is preferably at least 1.2 times greater than the first diameter, for example 1.5 times greater, 1.7 times greater or 2 times greater than the first diameter. The screen wires and the polymer wires are arranged helically around the insulation system layer. The screen wires and the polymer wires are preferably arranged in tension such that that they abut the insulation system layer. The screen wires and the polymer wires are arranged alternatingly with one or more screen wires arranged between every adjacent pair of polymer wires. To this end, the central axis of each screen wire is closer to the central axis of the conductor than the central axis of any polymer wire.

The screen wires may be made of an electrically conductive material, preferably metal such as copper. The polymer wires may comprise or consist of a polymer. An example of a polymeric material suitable for the polymer wires is polyethylene such as low density, medium density or high density polyethylene. The polymeric wires could alternatively be made of semiconducting material such as polyethylene mixed with carbon black. The polymer wires may advantageously be made of the same material as either the insulation system layer or the sheath. No new material, which would have to be subjected to comprehensive testing in the context of the dynamic submarine power cable, is introduced into the design of the dynamic submarine power cable in this manner.

The dynamic submarine power cable may comprise more than one core depending on the number of electrical phases and whether the dynamic submarine power cable is for AC use or DC use. In case of several cores, each conductor is surrounded by a respective insulation system layer, sheath and screen layer in the same manner as described above, thereby forming or forming part of a respective core.

With reference to FIG. 1, an example of a dynamic submarine power cable will now be described. The exemplified dynamic submarine power cable 1 comprises three cores. The dynamic submarine power cable 1 comprises a first core 3*a*, a second core 3*b* and a third core 3*c*. The first core 3*a* comprises a first conductor, a first insulation system layer 7*a*, which may form part of an electrical insulation system 7, a first screen layer 9*a* and a first sheath 11*a*, which first sheath 11 a may comprise one or more layers.

The first insulation system layer 7*a* is arranged around the first conductor 5*a*. The first screen layer 9*a* is arranged between the first insulation system layer 7*a* and the first sheath 11*a*. The first screen layer 9*a* comprises a plurality of first screen wires 13*a* and a plurality of first polymer wires 15*a*. The plurality of first screen wires 13*a* and the plurality of first polymer wires 15*a* are evenly distributed around the periphery of the first insulation system layer 7*a*. In any cross section of the dynamic submarine power cable 1, the first screen wires 13*a* and the first polymer wires 15*a* are arranged in an alternating manner around the periphery of the first insulation system layer 7*a*. Furthermore, the first screen wires 13*a* and the first polymer wires 15*a* are arranged in a helical manner around the first insulation system layer 7*a* in the axial direction of the first conductor 5*a*. The first screen wires 13*a* and the first polymer wires 15*a* are arranged in tension such that they all lie against, i.e. bear on, the outer surface of the first insulation system layer 7*a*.

According to the example in FIG. 1, there is only one first screen wire 13*a* arranged between every adjacent pair of first polymer wires 15*a*. This applies both in cross section and from a side view perspective of the first screen layer 9*a*. The number of first screen wires 13*a* hence equals the number of first polymer wires 15*a*. Each first screen wire 13*a* hence abuts two first polymer wires 15*a* and is squeezed in between two first polymer wires 15*a* to ensure that it lies essentially still and in physical contact with the first insulation system layer 7*a*.

Figure 2:
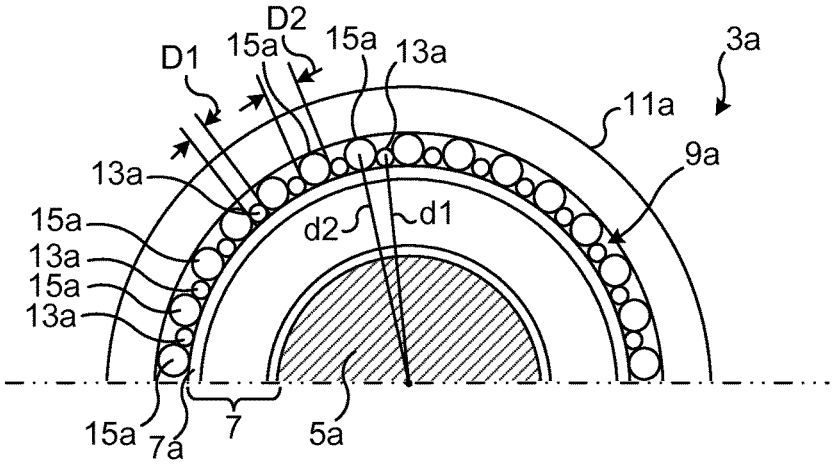
FIG. 2 shows one of the cores of the dynamic submarine power cable in FIG. 1.

Each first screen wire 13*a* has a first diameter D1 and each first polymer wire 15*a* has a second diameter D2, which second diameter D2 is greater than the first diameter D1, as shown in FIG. 2. Each first polymer wire 15*a* hence simultaneously abuts both the layer radially inside the first screen layer 9*a* and the layer radially outside the first screen layer 9*a*, e.g. the first insulation system layer 7*a* and the first sheath 11*a*. The first screen wires 13*a* however normally only abut the first insulation system layer 7*a* due to their tensioned state. The first screen wires 13*a* will therefore not be subjected to, or at least be subjected to substantially less, radial contact loads thereby reducing the build-up of frictional stress due to stick-slip during dynamic load conditions. The polymer material of the first polymer wires 15*a* is able to withstand large strain variations due to bending as well as frictional forces better than the first screen wires 13*a*, the latter being made of an electrically conductive material to provide electrical shielding of the first conductor 5*a*.

The second diameter D2 is at least 1.2 times greater than the first diameter D1, according to one example at least 1.5 times greater than the first diameter D1. According to a further example, the second diameter D2 is at least 1.7 times or 2 times greater than the first diameter D1. In general, the ratio between the first diameter D1 and the second diameter D2 shall be chosen on the basis that when e.g. the first core is subjected to radial loads representative for operation of the dynamic submarine power cable, the radial dimension, in the first screen layer, of any first polymer wire, due to ovalisation and penetration into adjacent layers, is larger than the first diameter D1. The first polymer wires are hence the only wires that are in physical contact with the first sheath. The first polymer wires therefore bear all radial load. The first screen wires do not contact the sheath. The ratio between the first diameter D1 and the second diameter D2 will thus depend on a number of design parameters, for example on the sheath material of the core, on the hardness of the sheath material, on the material of the first polymer wires 15*a*, and on the magnitude of the radial forces onto the cores during operation of the dynamic submarine power cable 1.

The second core 3*b* is identical to the first core 3*a* and to the third core. To this end, the second core 3*b*, for example, comprises a second conductor 5*b*, a second insulation system layer 7*b* arranged around the second conductor 5*b*, a second screen layer 9*b* comprising a plurality of second screen wires 13*b* and a plurality of second polymer wires 15*b*, and a second sheath 11*b*. Since the second core 3*b* and the third core 3*c* are identical to the first core 3*a*, the second core 3*b* and the third core 3*c* will not be described in any further detail herein.

The dynamic submarine power cable 1 further comprises three filler devices 17, each filler device 17 being arranged between a respective pair of two adjacent cores of the first core 3*a*, the second core 3*b* and the third core 3*c*. The filler device 17 shown in FIG. 1 is arranged between the first core 3*a* and the second core 3*b*.

The dynamic submarine power cable 1 comprises an armouring layer 19 and an outer sheath 23 arranged around the armouring layer 19. The armouring layer 19 comprises a plurality of helically wound armouring wires 21 arranged around the periphery formed by the first core 3*a*, the second core 3*b*, the third core 3*c* and the three filler devices 17. The armouring wires 21 may typically be arranged around the periphery of an intermediate sheath that is arranged around the three cores 3*a*, 3*b*, 3*c* and the three filler devices 17.

FIG. 2 shows half of the first core 3*a* in cross section. As can be seen, the radial distance d1 between the central axis of any of the first screen wires 13*a* and the central axis of the first conductor 5*a* is less than the radial distance d2 between the central axis of any of the first polymer wires 15*a* and the central axis of the first conductor 5*a*. To this end, the first screen wires 13*a* are only in physical contact with the inner layer of the two layers surrounding the first screen layer 9*a*, i.e. with the first insulation system layer 7*a*. Radial loads onto the core during operation are hence absorbed by the first polymer wires 15*a*.

The core configuration shown in FIG. 2 could be used in dynamic submarine power cables for AC applications, with the number of cores depending on the number of electrical phases, or for DC applications.

The inventive concept has mainly been described above with reference to a few examples. However, as is readily appreciated by a person skilled in the art, other embodiments than the ones disclosed above are equally possible within the scope of the inventive concept, as defined by the appended claims.

The invention claimed is:

1. A dynamic submarine power cable comprising:

a first conductor, a first insulation system layer arranged around the first conductor, a first sheath arranged around the first insulation system layer, and a first screen layer arranged between the first insulation system layer and the first sheath, wherein the first screen layer comprises a plurality of first screen wires each having a first diameter and a plurality of first polymer wires each having a second diameter which is larger than the first diameter, wherein the first screen wires and the first polymer wires are arranged in a helical manner around the first insulation system layer, along the axial direction of the first conductor, wherein in any cross-section of the dynamic submarine power cable the first screen wires and the first polymer wires are arranged alternatingly along the periphery of the first insulation system layer, wherein a radial distance between the central axis of any of the first screen wires and the central axis of the first conductor is less than a radial distance between the central axis of any of the first polymer wires and the central axis of the first conductor, and wherein each first polymer wire consists of a polymer material.

2. The dynamic submarine power cable according to claim 1, wherein each first polymer wire simultaneously abuts both the first insulation system layer and the first sheath.

3. The dynamic submarine power cable according to claim 2, wherein the number of first screen wires is equal to the number of first polymer wires.

4. The dynamic submarine power cable according to claim 1, wherein the number of first screen wires is equal to the number of first polymer wires.

5. The dynamic submarine power cable according to claim 1, wherein the second diameter is at least 1.2 times greater than the first diameter.

6. The dynamic submarine power cable according to claim 1, wherein each first screen wire is made of metal.

7. The dynamic submarine power cable according to claim 1, further including:

a second conductor, a second insulation system layer arranged around the second conductor, a second sheath arranged around the second insulation system layer, and a second screen layer arranged between the second insulation system layer and the second sheath, wherein the second screen layer comprises a plurality of second screen wires each having said first diameter and a plurality of second polymer wires each having said second diameter, wherein the second screen wires and the second polymer wires are arranged in a helical manner around the second insulation system layer, along the axial direction of the second conductor, and wherein in any cross-section of the dynamic submarine power cable the second screen wires and the second polymer wires are arranged alternatingly along the periphery of the second insulation system layer, wherein a radial distance between the central axis of any of the second screen wires and the central axis of the second conductor is less than a radial distance between the central axis of any of the second polymer wires and the central axis of the second conductor.

8. The dynamic submarine power cable according to claim 7, wherein each second polymer wire simultaneously abuts both the second insulation system layer and the second sheath.

9. The dynamic submarine power cable according to claim 8, wherein the number of second screen wires is equal to the number of second polymer wires.

10. The dynamic submarine power cable according to claim 7, wherein the number of second screen wires is equal to the number of second polymer wires.

11. The dynamic submarine power cable according to claim 7, wherein each second screen wire is made of metal.

12. The dynamic submarine power cable according to claim 7, wherein each second polymer wire consists of a polymer material.

13. The dynamic submarine power cable according to claim 7, further including:

a third conductor, a third insulation system layer arranged around the third conductor, a third sheath arranged around the third insulation system layer, a third screen layer arranged between the third insulation system layer and the third sheath, wherein the third screen layer comprises a plurality of third screen wires each having said first diameter and a plurality of third polymer wires each having said second diameter, wherein the third screen wires and the third polymer wires are arranged in a helical manner around the third insulation system layer, along the axial direction of the third conductor, and wherein in any cross-section of the dynamic submarine power cable the third screen wires and the third polymer wires are arranged alternatingly along the periphery of the third insulation system layer, wherein a radial distance between the central axis of any of the third screen wires and the central axis of the third conductor is less than a radial distance between the central axis of any of the third polymer wires and the central axis of the third conductor.

14. The dynamic submarine power cable according to claim 13, wherein each third polymer wire simultaneously abuts both the third insulation system layer and the third sheath.

15. The dynamic submarine power cable according to claim 13, wherein the number of third screen wires is equal to the number of third polymer wires.

16. The dynamic submarine power cable according to claim 13, wherein each third screen wire is made of metal.

17. The dynamic submarine power cable according to claim 13, wherein each third polymer wire consists of a polymer material.

18. The dynamic submarine power cable according to claim 13, wherein the first sheath forms part of a first core, the second sheath forms part of a second core and the third sheath forms part of a third core, wherein the dynamic submarine power cable comprises:

an armouring layer comprising a plurality of armouring wires, three filler devices, each filler device being arranged between a respective pair of adjacent cores of the first core, the second core and the third core, wherein the armouring layer is arranged around the first core, the second core, the third core and the three filler devices, and an outer sheath arranged around the armouring layer.

19. The dynamic submarine power cable according to claim 1, wherein the dynamic submarine power cable is a medium voltage power cable or a high voltage power cable.

* * * * *